US008882606B2

(12) United States Patent
Leech et al.

(10) Patent No.: US 8,882,606 B2
(45) Date of Patent: Nov. 11, 2014

(54) GOLF SWING DATA GATHERING METHOD AND SYSTEM

(75) Inventors: Nicholas A. Leech, Aloha, OR (US); Arthur Molinari, Beaverton, OR (US); Yutaka Kabeshita, Portland, OR (US); Yasushi Ichikawa, Tualatin, OR (US); Derek A. Fitchett, Portland, OR (US); Bradley C. Tutmark, Aloha, OR (US)

(73) Assignee: NIKE, Inc., Beaverton, OR (US)

( * ) Notice: Subject to any disclaimer, the term of this patent is extended or adjusted under 35 U.S.C. 154(b) by 179 days.

(21) Appl. No.: 12/695,889

(22) Filed: Jan. 28, 2010

(65) Prior Publication Data

US 2011/0183780 A1 Jul. 28, 2011

(51) Int. Cl.

| | |
|---|---|
| ***A63B 69/36*** | (2006.01) |
| ***A63B 71/06*** | (2006.01) |
| ***A63B 24/00*** | (2006.01) |

(52) U.S. Cl.

CPC ..... *A63B 24/0006* (2013.01); *A63B 2243/0029* (2013.01); *A63B 71/0669* (2013.01); *A63B 2225/20* (2013.01); *A63B 2225/50* (2013.01)

USPC ..... 473/223; 473/226; 473/283; 473/353

(58) Field of Classification Search

CPC ..... A63B 69/3614; A63B 69/3623; A63B 69/3658

USPC ..... 473/223, 226, 283, 353

See application file for complete search history.

(56) References Cited

U.S. PATENT DOCUMENTS

| | | | | |
|---|---|---|---|---|
| 4,375,887 | A | 3/1983 | Lynch et al. | |
| 5,319,548 | A | 6/1994 | Germain | |
| 5,743,812 | A | 4/1998 | Card | |
| 5,779,555 | A * | 7/1998 | Nomura et al. | 473/223 |
| 6,013,007 | A | 1/2000 | Root et al. | |
| 6,086,487 | A | 7/2000 | Morgan et al. | |
| 6,186,002 | B1 | 2/2001 | Lieberman et al. | |
| 6,192,323 | B1 | 2/2001 | Boehm | |
| 6,385,559 | B2 | 5/2002 | Boehm | |
| 6,431,990 | B1 | 8/2002 | Manwaring | |
| 6,456,938 | B1 | 9/2002 | Barnard | |

(Continued)

FOREIGN PATENT DOCUMENTS

| | | |
|---|---|---|
| CN | ZL201120031312.0 | 4/2012 |
| CN | ZL201220048916.0 | 3/2013 |

(Continued)

OTHER PUBLICATIONS

European Patent Application and European Search Report published Aug. 10, 2011 in European Patent Application 11152290.0.

(Continued)

*Primary Examiner* — Lawrence Galka

(74) *Attorney, Agent, or Firm* — Plumsea Law Group, LLC

(57) ABSTRACT

A method and system for capturing, transmitting, and displaying golf swing data uses data capture elements in golf balls or golf clubs to capture data and transmission elements to transmit the golf swing data to a mobile computing auxiliary device. The mobile computing auxiliary device relays the captured and transmitted golf swing data to a mobile computing device. The mobile computing device transmits the golf swing data to a database. A server associated with the database generates web pages to make the golf swing data available over the internet.

20 Claims, 16 Drawing Sheets

(56) References Cited

U.S. PATENT DOCUMENTS

| | | | | |
|---|---|---|---|---|
| 6,490,542 | B2 | 12/2002 | Boehm | |
| 6,561,917 | B2 | 5/2003 | Manwaring | |
| 6,611,792 | B2 | 8/2003 | Boehm | |
| 6,658,371 | B2 | 12/2003 | Boehm et al. | |
| 6,672,978 | B1 | 1/2004 | Morgan et al. | |
| 6,697,820 | B1 | 2/2004 | Tarlie | |
| 6,760,685 | B2 | 7/2004 | Boehm | |
| 6,908,404 | B1 * | 6/2005 | Gard | 473/407 |
| 7,048,651 | B2 | 5/2006 | Kennedy et al. | |
| 7,072,789 | B2 | 7/2006 | Vock et al. | |
| 7,118,498 | B2 | 10/2006 | Meadows et al. | |
| 7,264,554 | B2 | 9/2007 | Bentley | |
| 7,341,527 | B1 | 3/2008 | Fisher | |
| 7,448,323 | B2 | 11/2008 | Kennedy et al. | |
| 7,503,858 | B2 | 3/2009 | Cameron | |
| 7,736,242 | B2 | 6/2010 | Stites et al. | |
| 7,762,911 | B2 | 7/2010 | Gobush | |
| 7,766,737 | B2 | 8/2010 | Sanders | |
| 7,837,572 | B2 | 11/2010 | Bissonnette et al. | |
| 7,887,439 | B2 | 2/2011 | Aoyama | |
| 2002/0082775 | A1 | 6/2002 | Meadows et al. | |
| 2003/0228934 | A1 | 12/2003 | Corzilius et al. | |
| 2004/0073325 | A1 * | 4/2004 | Reeves | 700/91 |
| 2005/0107179 | A1 | 5/2005 | Munshi | |
| 2005/0215340 | A1 * | 9/2005 | Stites et al. | 473/233 |
| 2005/0233815 | A1 * | 10/2005 | McCreary et al. | 473/131 |
| 2006/0029916 | A1 | 2/2006 | Boscha | |
| 2006/0040756 | A1 | 2/2006 | Kestler | |
| 2007/0049393 | A1 | 3/2007 | Gobush | |
| 2007/0087866 | A1 | 4/2007 | Meadows et al. | |
| 2007/0111811 | A1 * | 5/2007 | Grober | 473/131 |
| 2007/0167236 | A1 | 7/2007 | Heckendorf | |
| 2008/0085778 | A1 * | 4/2008 | Dugan | 473/223 |
| 2008/0182685 | A1 | 7/2008 | Marty et al. | |
| 2008/0220891 | A1 | 9/2008 | Gobush et al. | |
| 2008/0220892 | A1 * | 9/2008 | Williamson et al. | 473/223 |
| 2008/0287207 | A1 | 11/2008 | Manwaring | |
| 2009/0017944 | A1 * | 1/2009 | Savarese et al. | 473/407 |
| 2009/0036237 | A1 | 2/2009 | Nipper et al. | |
| 2009/0048039 | A1 | 2/2009 | Holthouse | |
| 2009/0111602 | A1 | 4/2009 | Savarese | |
| 2009/0209358 | A1 * | 8/2009 | Niegowski | 473/223 |
| 2009/0233735 | A1 | 9/2009 | Savarese | |
| 2009/0298605 | A1 | 12/2009 | Wiegers | |
| 2009/0325721 | A1 | 12/2009 | Esayian et al. | |
| 2009/0326688 | A1 | 12/2009 | Thomas et al. | |
| 2010/0004039 | A1 | 1/2010 | Kelly, Jr. et al. | |
| 2010/0009780 | A1 | 1/2010 | Doherty et al. | |
| 2010/0087936 | A1 | 4/2010 | Roullier | |
| 2010/0093458 | A1 * | 4/2010 | Davenport et al. | 473/223 |
| 2010/0144456 | A1 * | 6/2010 | Ahern | 473/222 |
| 2010/0151955 | A1 * | 6/2010 | Holden | 473/199 |
| 2010/0179005 | A1 | 7/2010 | Meadows et al. | |
| 2010/0210377 | A1 | 8/2010 | Lock | |
| 2010/0304876 | A1 | 12/2010 | Hohla et al. | |
| 2011/0086720 | A1 | 4/2011 | Jaekel et al. | |
| 2011/0098133 | A1 | 4/2011 | Shiga et al. | |

FOREIGN PATENT DOCUMENTS

| | | |
|---|---|---|
| JP | 09215808 | 8/1997 |
| JP | 2004135706 | 5/2004 |
| JP | 2005058325 | 10/2005 |
| JP | 2006136415 | 6/2006 |
| JP | 2007014671 | 1/2007 |
| JP | 2007167195 | 7/2007 |
| JP | 2008073210 | 4/2008 |
| JP | 2008295654 | 12/2008 |
| JP | 2011515164 | 5/2011 |
| WO | WO0021014 | 4/2000 |
| WO | WO0059587 | 10/2000 |
| WO | WO0071212 | 11/2000 |

OTHER PUBLICATIONS

Notification of Grant of Patent Right for Utility Model for Chinese Utility Model Patent Application No. 201120031312.0, issued on Dec. 1, 2011.

Communication pursuant to Article 94(3) EPC for European Patent Application No. EP11152290.0, mailed on Jun. 14, 2012.

Office Action mailed Apr. 3, 2013 in Chinese Invention Patent Application No. 201110031878.8.

Response to Office Action mailed Apr. 3, 2013 in Chinese Invention Patent Application No. 201110031878.8 as filed on Aug. 2, 2013 and the English translation thereof.

Response to Office Action mailed Jan. 28, 2013 in European Patent Application No. 11152290.0 as filed on Jun. 7, 2013.

Response to Office Action mailed Jan. 29, 2013 in Japanese Patent Application No. 2011-015055 as filed on Apr. 26, 2013 and the English translation thereof.

Office Action mailed May 31, 2013 in Taiwan Patent Application No. 100101082.

Office Action mailed Aug. 1, 2012 in Chinese Utility Model Patent Application No. 201220048916.0.

Notification of Grant mailed Dec. 4, 2012 in Chinese Utility Model Patent Application No. 201220048916.0.

Office Action in Japanese Patent Application No. 2011-015055, issued on Jan. 29, 2013.

Communication Pursuant to Article 94(3) EPC in EPO Application No. EP 11 152 290.0, mailed on Jan. 28, 2013.

Office Action mailed Dec. 4, 2013 in Chinese Invention Patent Application No. 201110031878.8 and the English translation thereof.

Response to Office Action mailed Dec. 4, 2014 in Chinese Invention Patent Application No. 201110031878.8 as filed on Jan. 27, 2014.

Communication pursuant to Article 94(3) EPC in European Patent Application No. 11152290.0 mailed Feb. 6, 2014.

Office Action mailed Jan. 28, 2014 in Japanese Patent Application No. 2011-015055 and the English translation thereof.

Response to Office Action mailed May 13, 2013 in Taiwan Patent Application No. 100101082 as filed on Nov. 29, 2013 and the English translation thereof.

Notice of Allowance mailed Feb. 26, 2014 in Taiwan Patent Application No. 100101082 and the English translation thereof.

* cited by examiner

GOLF SWING DATA GATHERING METHOD AND SYSTEM

BACKGROUND

The present disclosure relates generally to the use of sports equipment and a mobile computing device to track sports performance data. More specifically, the present disclosure relates generally to capturing, transmitting, and displaying data regarding parameters associated with golf swings.

A game of golf is generally played on a golf course having one or more holes. Each hole of the game played typically has a teeing area and a hole (or hole containing a cup). In the course of the game, a golf club is swung to strike a golf ball in an effort to move the golf ball into the hole.

A number of swings may be required to successfully move the golf ball into the hole. The specific movement of the ball achieved by any particular swing may be influenced by diverse factors. One set of such factors may be any of the complicated physiological or biomechanical processes involved in swinging a golf club to hit a golf ball. Another set of such factors may be a range of relatively more controllable physical conditions, such as the type of golf club and the type of golf ball used. Yet another range of such factors may be a range of relatively less controllable physical conditions, such as wind speed, lighting, temperature, and humidity.

Any particular golf swing may also be characterized by a range of parameters resulting from the diverse factors influencing the specific movement of the ball. Some may relate to geographical locations, such as the location of the ball at the beginning of the swing, or the location of the ball where it has come to rest after the swing. Other parameters may relate to the type of club, or to the location or nature of the golfer's grip on the golf club. Still other parameters may relate to the speed of the golf club, such as the speed of the club at the moment of contact with the ball, or a speed profile of the club during the swing. Further parameters may relate to the spatial position and orientation of the golf club, such as the spatial position and orientation of the golf club at the moment of contact with the ball, or a profile of spatial positions and orientations of the golf club during the swing. Other parameters may relate to the location on the face of the club of the point of contact between the club and the ball, or to the spatial orientation of the face of the club at the moment of contact with the ball. More parameters may relate to the golf ball, such as the type of golf ball used, a speed or acceleration of the golf ball, or a spin of the golf ball during flight.

Data regarding golf swing parameters may be useful in improving a golfer's performance. In-person instruction may identify golf swing parameters serving to hinder or limit performance, and video recording and playback of golf swings may enable subsequent analysis of such golf swings. However, such instruction, recording, and analysis may involve expenses and inconveniences that not every golfer can overcome. At the same time, the recording and tracking of data with respect to golf swing parameters may be of general interest to golfers. Score-cards may be provided by golf courses for use in determining a golfer's score in a game, for example; however, such mechanisms may not be suited to record the range of golf swing parameters, and the determination and recording of data associated with golf swing parameters, if attempted manually, may not be conducive to enjoyment of the game.

Therefore, a need exists in the art for a way for golfers to gather and usefully present golf swing data regarding a range of parameters.

SUMMARY

In one aspect, the invention provides a method for capturing and transmitting golf swing data comprising the steps of: (i) capturing golf swing data in at least one of a ball data module and a club data module, wherein the golf swing data comprises at least one of a ball-related golf swing datum and a club-related golf swing datum; (ii) waiting for a trigger condition; (iii) executing a transmit-side of a synchronization protocol, wherein the transmit-side of the synchronization protocol cooperates with a receive-side of the synchronization protocol to coordinate a transmit-side of a data-transmission protocol and a receive-side of a data-transmission protocol; and (iv) executing the transmit-side of a data transmission protocol, wherein executing the transmit-side of the data transmission protocol causes the golf swing data to be transmitted.

In another aspect, the invention provides a method for receiving and conveying golf swing data comprising the steps of (i) waiting for a trigger condition; (ii) executing a receive-side of a synchronization protocol, wherein the receive-side of the synchronization protocol cooperates with a transmit-side of the synchronization protocol to coordinate a transmit-side of a data-transmission protocol and a receive-side of a data-transmission protocol; (iii) executing the receive-side of a data transmission protocol, wherein executing the receive-side of the data transmission protocol causes a mobile computing auxiliary device to receive golf swing data, and wherein the golf swing data comprises at least one of a ball-related golf swing datum and a club-related golf swing datum; and (iv) conveying the golf swing data to a mobile computing device.

In another aspect, the invention provides a system for capturing and communicating golf swing data comprising a data module, the data module having a data capture element for capturing golf swing data and a data transmission element for transmitting golf swing data, and a mobile computing auxiliary device, the mobile computing auxiliary device having an auxiliary receiving element for receiving golf swing data; wherein the data module is one of a ball data module incorporated in a golf ball and a club data module incorporated in a golf club.

In another aspect, the invention provides a system for capturing and communicating golf swing data, the system comprising a data module, the data module having a data capture element for capturing golf swing data and a data transmission element for transmitting golf swing data; a mobile computing auxiliary device, the mobile computing auxiliary device having an auxiliary receiving element for receiving golf swing data; and a mobile computing device, the mobile computing device having a view screen; wherein the data module is one of a ball data module incorporated in a golf ball and a club data module incorporated in a golf club.

In another aspect, the invention provides a system for capturing, storing, and communicating golf swing data comprising a database including a first set of golf swing data, the database including a memory for storing data, the first set of golf swing data including at least one of a ball-related golf swing datum and a club-related golf swing datum; and a server interoperating with the database, the server being operative to transmit a web page incorporating the first set of golf swing data, and the web page facilitating at least one of a competition and a challenge.

Other systems, methods, features, and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale; instead, emphasis is placed upon illustrating the principles of the invention. Moreover, in the figures, like reference numerals designate corresponding parts throughout the different views.

DETAILED DESCRIPTION

A method and a system for golfers to use in capturing, transmitting, and displaying golf swing data is provided.

Figure 1:
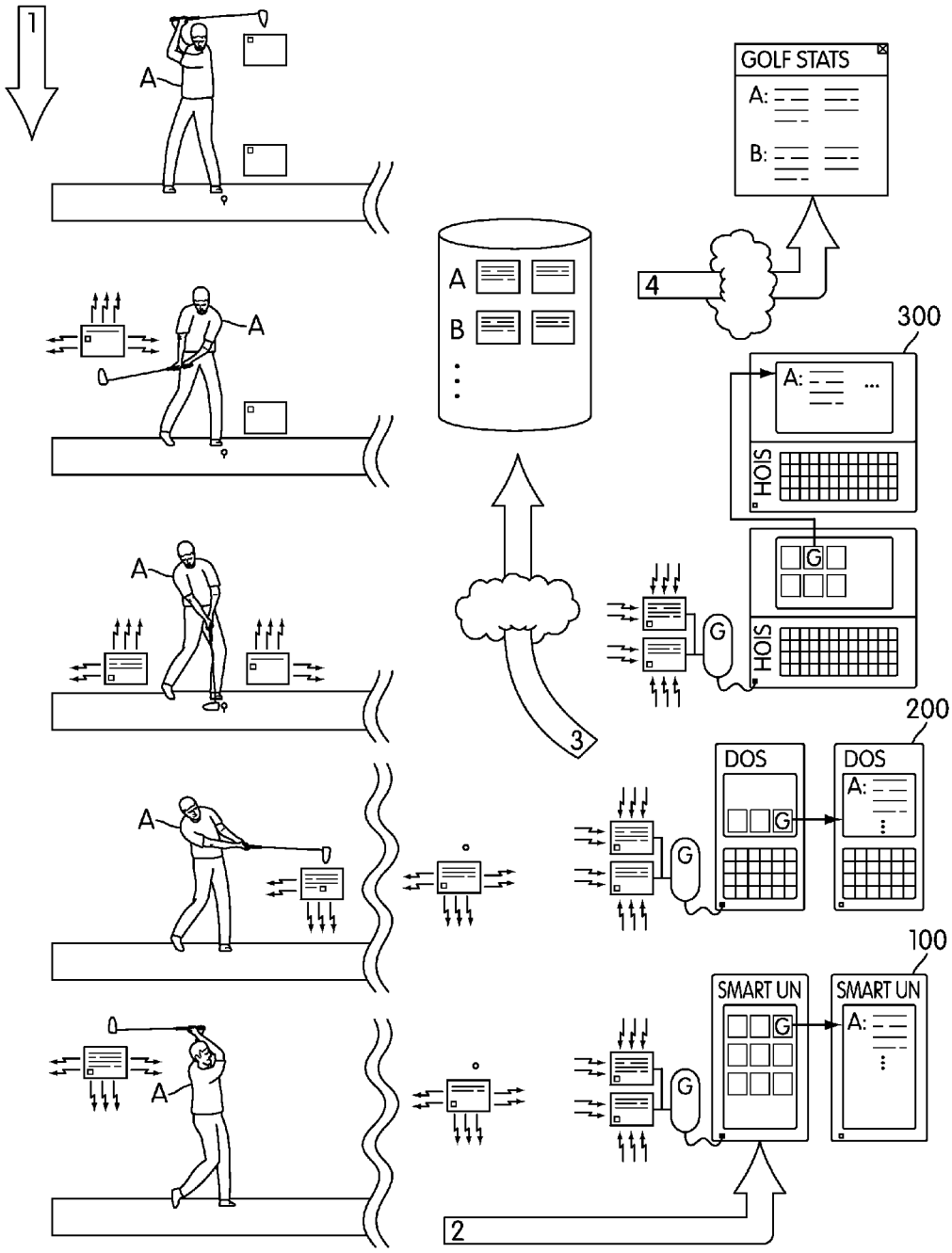
FIG. 1 depicts an embodiment of a golf ball, a golf club, a mobile computing auxiliary device, a mobile computing device, a database, and a web page.

FIG. 1 depicts an embodiment of a golf ball, a golf club, mobile computing auxiliary devices, mobile computing devices, a database, and a web page. Referring to FIG. 1, data modules in a golf ball and a golf club may capture data associated with a golf swing during the course of the golf swing. The data modules may transmit the captured golf swing data.

A mobile computing auxiliary device may then receive the transmitted golf swing data. In some embodiments, the mobile computing auxiliary device may be physically separate from the golf ball, the golf club, or both. In such embodiments, a data module in the golf ball or the golf club may transmit the captured golf swing data and the mobile computing auxiliary device may receive the transmitted golf swing data through a wireless communication mechanism.

Appropriate wireless communication mechanisms include radio frequency communication, cellular telephone communication, wireless networking communication, and wireless point-to-point communication. In some embodiments, the wireless communication mechanism may transmit or receive data wirelessly through mechanisms based on RFID (radio-frequency identification) tags. In other embodiments, the wireless communication mechanism may transmit or receive data wirelessly through electronics implementing a Bluetooth communication mechanism.

In other embodiments of the mobile computing auxiliary device, a mobile computing auxiliary device 30 may be integrated within a golf ball 10 or a golf club 20. In such embodiments, mobile computing auxiliary device 30 may receive data transmitted from whichever piece of golfing equipment it is not integrated within (i.e., golf club 20 or golf ball 10, respectively), through a wireless communication mechanism. In still other embodiments, mobile computing auxiliary device 30 may be integrated within a mobile computing device 100. In such embodiments, mobile computing auxiliary device 30 may receive data transmitted from golf ball 10 or golf club 20 via a wireless communication mechanism.

The mobile computing auxiliary device may communicate the golf swing data to a mobile computing device, such as first mobile computing device 100, second mobile computing device 200, or third mobile computing device 300. In some embodiments, the mobile computing device may be a pager, a cell phone, or a smart phone, such as an IPHONE, a product of Apple Inc. of Cupertino, Calif. In other embodiments, the mobile computing device may be a computer, such as a laptop computer or a netbook computer.

In some embodiments, mobile computing auxiliary device 30 may physically interface with mobile computing device 100. In such embodiments, golf swing data may be transmitted physically over a wired communications mechanism, such as a cable, a wire, or a bus. In other embodiments, the mobile computing auxiliary device 30 may wirelessly interface with mobile computing device 100. In such embodiments, golf swing data may be transmitted wirelessly over a wireless communication mechanism.

The mobile computing device may display the golf swing data. For example, the mobile computing device may display golf swing data as a hierarchically-organized set of data through which the mobile computing device may browse. Additionally, the mobile computing device may transmit golf swing data to the database. Subsequently, golf swing data transmitted to the database may be made available over the internet. In some embodiments, the data may be made available on a web page, along with golf swing data from other users.

Figure 2A:
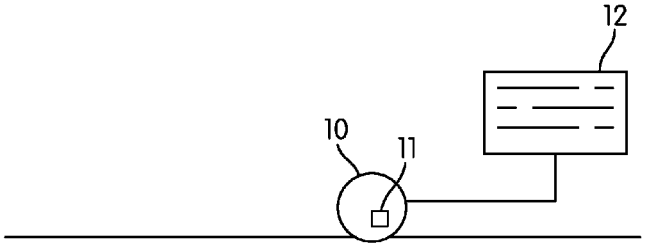
FIG. 2A is a schematic plan view of an embodiment of a golf ball.

FIGS. 2A-4A depict embodiments of golf ball 10 transmitting ball-related golf swing data 12 to mobile computing auxiliary device 30. FIG. 2A is a schematic plan view of an embodiment of golf ball 10. Referring to FIG. 2A, golf ball 10 has come to rest after having been struck by a golf club. Golf ball 10 may be any type of ball used for playing golf. Within golf ball 10, ball data module 11 has captured ball-related golf swing data 12.

Ball-related golf swing data 12 may include data regarding any of a number of parameters that may be used to characterize a golf swing. Ball-related golf swing data 12 may include data regarding the type of golf ball used. Ball-related golf swing data 12 may also include data regarding the location of golf ball 10, either at the beginning of the swing or after golf ball 10 has come to rest. Ball-related golf swing data 12 may include data regarding a speed or acceleration of golf ball 10. Ball-related golf swing data 12 may also include data regarding the spin of golf ball 10 during flight, such as a back spin or a side spin.

Figure 2B:
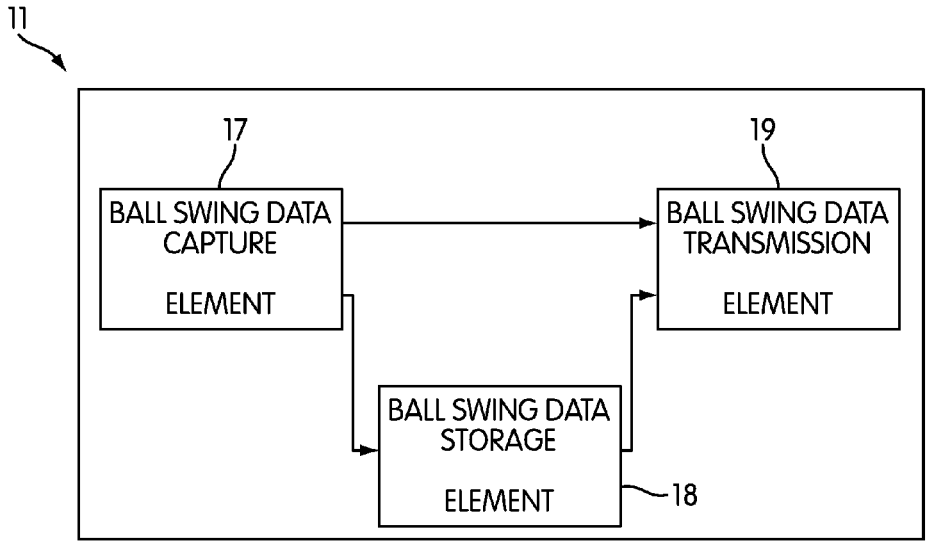
FIG. 2B is a block diagram of an embodiment of a ball data module.

FIG. 2B is a block diagram of an embodiment of ball data module 11. Data capture element 17 in ball data module 11 may capture ball-related golf swing data 12. In some embodiments, data capture element 17 may include a GPS (global positioning system) receiver. In other embodiments, data capture element 17 may include one or more accelerometers. In still other embodiments, data capture element 17 may include one or more piezoelectric mechanisms.

Figure 3:
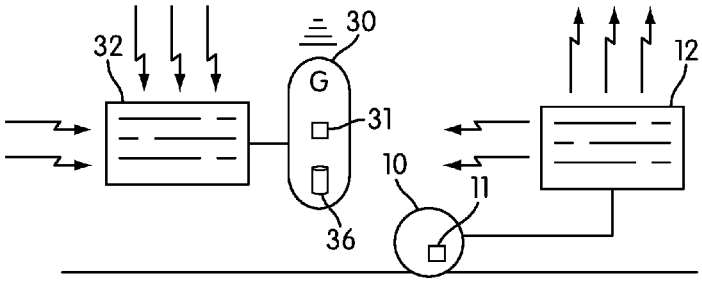
FIG. 3 is a schematic plan view of an embodiment of a golf ball and a mobile computing auxiliary device placed in proximity with each other.

FIG. 3 is a schematic plan view of an embodiment of golf ball 10 and mobile computing auxiliary device 30 placed in proximity with each other. Referring to FIG. 3, mobile computing auxiliary device 30 has been placed in proximity to golf ball 10. Subsequently, transmission element 19 in ball data module 11 may transmit ball-related golf swing data 12. In some embodiments, transmission element 19 may transmit data captured by capture element 17. In other embodiments, transmission element 19 may transmit data stored in storage element 18 (which may include any type of memory, volatile or non-volatile) after having previously been captured by capture element 17.

Ball-related golf swing data 12 may be transmitted wirelessly through a wireless communication mechanism. In some embodiments, transmission element 19 may include a built-in RFID (radio-frequency identification) tag. In other embodiments, transmission element 19 may include built-in electronics implementing a Bluetooth communication device.

In the first embodiment, the transmission of ball-related golf swing data 12 by transmission element 19 is triggered by bringing golf ball 10 and mobile computing auxiliary device 30 in proximity with each other. In other embodiments, the transmission of ball-related golf swing data 12 by transmission element 19 need not be triggered by bringing golf ball 10 and mobile computing auxiliary device 30 in proximity with each other. For example, the transmission of ball-related golf swing data 12 by transmission element 19 may be triggered by a periodic timer of ball data module 11, and the running of the periodic timer itself may be delayed by some amount of time.

Figure 4A:
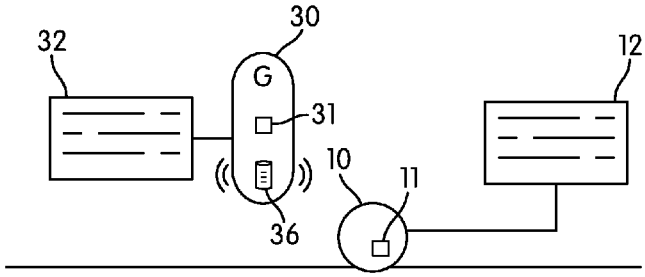
FIG. 4A is a schematic plan view of an embodiment of a golf ball and a mobile computing auxiliary device in proximity with each other.

FIG. 4A is a schematic plan view of an embodiment of golf ball 10 and mobile computing auxiliary device 30 in proximity with each other. Within mobile computing auxiliary device 30, auxiliary data module 31 has captured ball-related golf swing data 12.

Figure 4B:
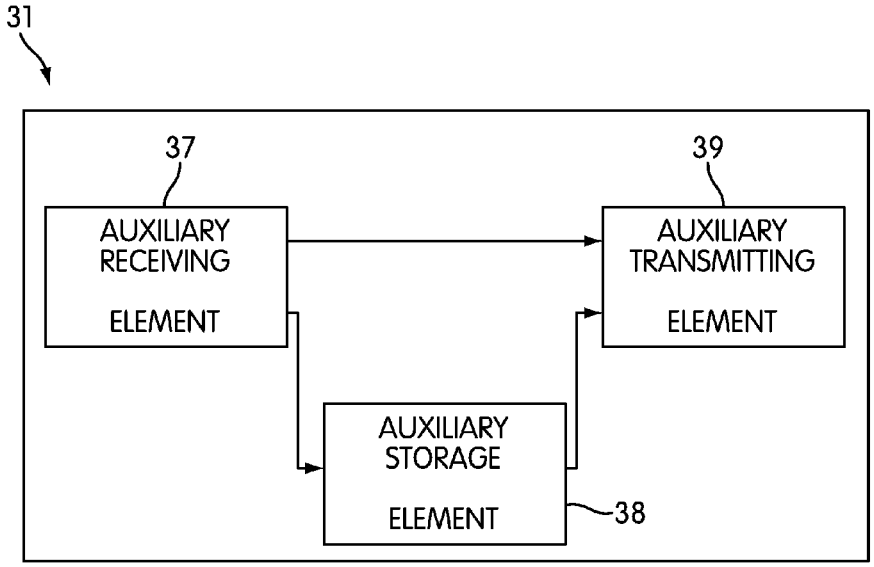
FIG. 4B is a block diagram of an embodiment of an auxiliary data module.

FIG. 4B is a block diagram of an embodiment of auxiliary data module 31. Referring to FIGS. 4A and 4B, receiving element 37 in auxiliary data module 31 of mobile computing auxiliary device 30 has received ball-related golf swing data 12. Receiving element 37 may include a wireless communication mechanism complementary to the wireless communication mechanism used to transmit ball-related golf swing data 12. For example, in embodiments of golf ball 10 in which transmission element 19 in ball data module 11 includes built-in electronics implementing a Bluetooth communication device, receiving element 37 in mobile computing auxiliary device 30 may include another Bluetooth communication device to receive ball-related golf swing data 12.

Once received, ball-related golf swing data 12 may be captured as ball-related golf swing data 32. Upon capturing ball-related golf swing data 32, mobile computing auxiliary device 30 may activate confirmation indicator 36 to confirm receipt of ball-related golf swing data 12. Confirmation indicator 36 may include an audible indicator, a visible indicator, a tactile indicator, or a combination of the three. For example, in some embodiments, confirmation indicator 36 may produce a chime, ring, chirp, or other sound. In other embodiments, confirmation indicator 36 may modify a liquid-crystal display or activate an LED (light-emitting diode). In yet other embodiments, confirmation indicator 36 may produce a vibration.

Figure 5A:
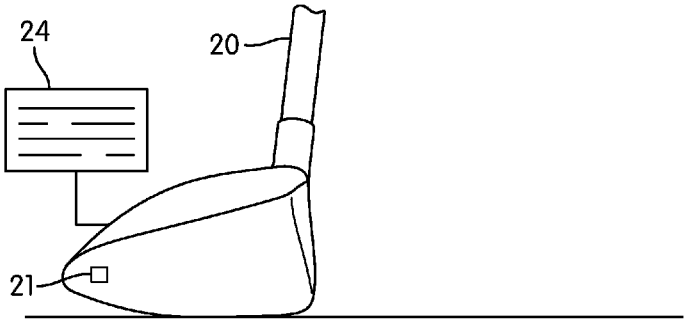
FIG. 5A is a schematic plan view of an embodiment of a golf club.

FIGS. 5A-7 depict embodiments of golf club 20 transmitting club-related golf swing data 12 to mobile computing auxiliary device 30. FIG. 5A is a schematic plan view of an embodiment of golf club 20. Referring to FIG. 5A, golf club 20 has been used to strike a golf ball. Golf club 20 may be any type of club used for playing golf, such as a driver, a wood, an iron, or a putter. Within golf club 20, club data module 21 has captured club-related golf swing data 24.

Club-related golf swing data 24 may include data regarding any of a number of parameters that may be used to characterize a golf swing. Club-related golf swing data 24 may include data regarding the type of club used. Club-related golf swing data 24 may also include data regarding the location or nature of the golfer's grip on golf club 20. Club-related golf swing data 24 may include data regarding the speed of golf club 20, such as the speed of one or more parts of golf club 20 at the moment of contact with the golf ball, or a speed profile of golf club 20 during the swing. Club-related golf swing data 24 may also include data regarding the spatial position and orientation of golf club 20, such as the spatial position and orientation of one or more parts of golf club 20 at the moment of contact with the ball, or a profile of spatial positions and orientations of golf club 20 during the swing. Club-related golf swing data 24 may include the spatial orientation of the face of golf club 20 at the moment of contact with the ball, or the location on the face of golf club 20 of the point of contact between golf club 20 and the golf ball.

Figure 5B:
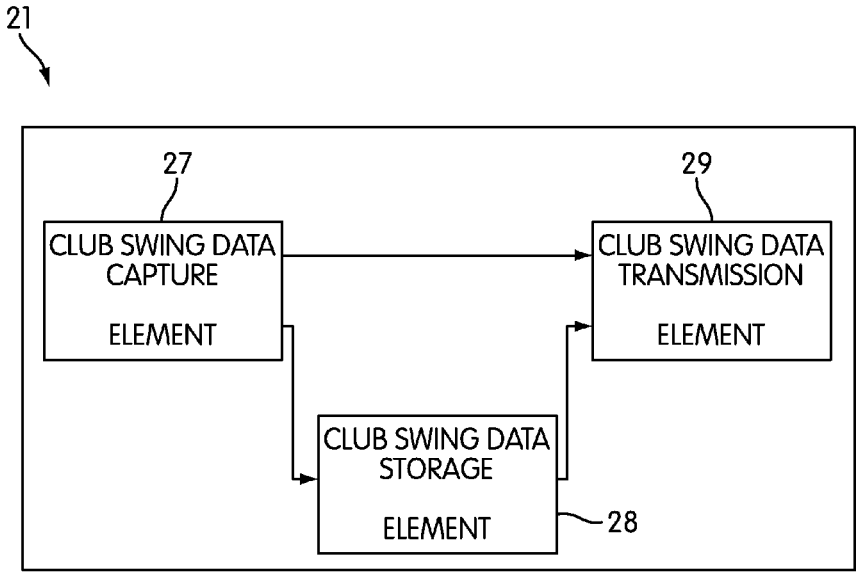
FIG. 5B is a block diagram of an embodiment of a club data module.

FIG. 5B is a block diagram of an embodiment of club data module 21. Data capture element 27 in club data module 21 may capture club-related golf swing data 24. In some embodiments, data capture element 27 may include one or more accelerometers. In other embodiments, data capture element 27 may include one or more piezoelectric mechanisms. In still other embodiments, data capture element 27 may include one or more sensors mounted on, integrated within, or otherwise made auxiliary to golf club 20.

Figure 6:
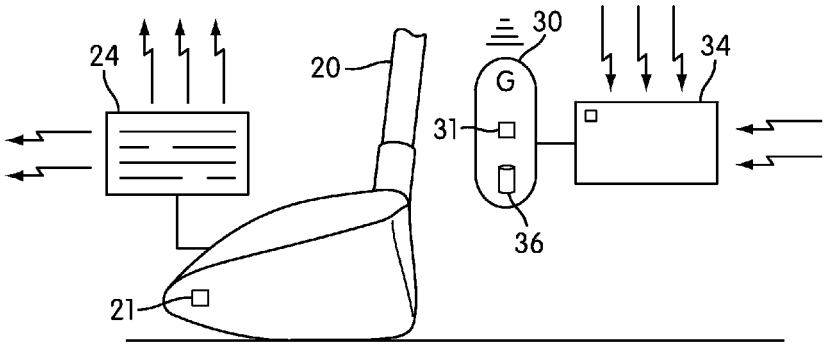
FIG. 6 is a schematic plan view of an embodiment of a golf club and a mobile computing auxiliary device placed in proximity with each other.

FIG. 6 is a schematic plan view of an embodiment of golf club 20 and mobile computing auxiliary device 30 placed in proximity with each other. Referring to FIG. 6, mobile computing auxiliary device 30 has been placed in proximity to golf club 20. Subsequently, transmission element 29 in club data module 21 may transmit club-related golf swing data 24. In some embodiments, transmission element 29 may transmit data captured by capture element 27. In other embodiments, transmission element 29 may transmit data stored in storage element 28 (which may include any type of memory, volatile or non-volatile) after having previously been captured by capture element 27.

Club-related golf swing data 24 may be transmitted wirelessly by any type of wireless communication mechanism. In some embodiments, transmission element 29 in club data module 21 may include a built-in RFID tag. In other embodiments, transmission element 29 in club data module 21 may include built-in electronics implementing a Bluetooth communication device.

In the first embodiment, the transmission of club-related golf swing data 24 by transmission element 29 is triggered by bringing golf club 20 and mobile computing auxiliary device 30 in proximity with each other. In other embodiments the transmission of club-related golf swing data 24 by transmission element 29 need not be triggered by bringing golf ball 10 and mobile computing auxiliary device 30 in proximity with each other, but may instead be triggered by a periodic timer of club data module 21, which itself may be delayed by some amount of time.

Figure 7:
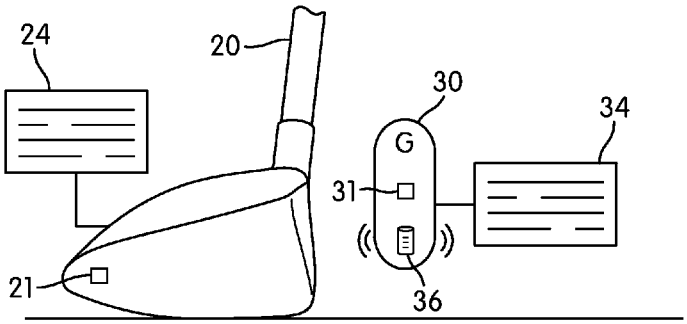
FIG. 7 is a schematic plan view of an embodiment of a golf club and a mobile computing auxiliary device in proximity with each other.

FIG. 7 is a schematic plan view of an embodiment of golf club 20 and mobile computing auxiliary device 30 in proximity with each other. Within mobile computing auxiliary device 30, auxiliary data module 31 has captured club-related golf swing data 24.

Referring to FIGS. 4B and 7, receiving element 37 in auxiliary data module 31 of mobile computing auxiliary device 30 has received club-related golf swing data 24. Receiving element 37 may include a wireless communication mechanism complementary to the wireless communication mechanism used to transmit club-related golf swing data 24 from golf club 20. For example, in embodiments of golf club 20 in which transmission element 29 club data module 21 includes built-in electronics implementing a Bluetooth communication device, receiving element 37 in mobile computing auxiliary device 30 may implement another Bluetooth communication device to receive club-related golf swing data 24.

Once received, club-related golf swing data 24 may be captured as club-related golf swing data 34. Upon capturing club-related golf swing data 34, mobile computing auxiliary device 30 may activate confirmation indicator 36 to confirm receipt of club-related golf swing data 24. Confirmation indicator 36 may include an audible indicator, a visible indicator, a tactile indicator, or a combination of the three. For example, in some embodiments, confirmation indicator 36 may produce a chime, ring, chirp, or other sound. In other embodiments, confirmation indicator 36 may modify a liquid-crystal display or activate an LED (light-emitting diode). In yet other embodiments, confirmation indicator 36 may produce a vibration.

In some embodiments, receiving element 37 in auxiliary data module 31 of mobile computing auxiliary device 30, or more than one receiving element in mobile computing auxiliary device 30, may receive both ball-related golf swing data 12 and club-related golf swing data 24. In such embodiments, mobile computing auxiliary device 30 may have separate or distinct confirmation indicators for confirming the receipt of ball-related golf swing data 12 and confirming the receipt of club-related golf swing data 24.

Figure 8:
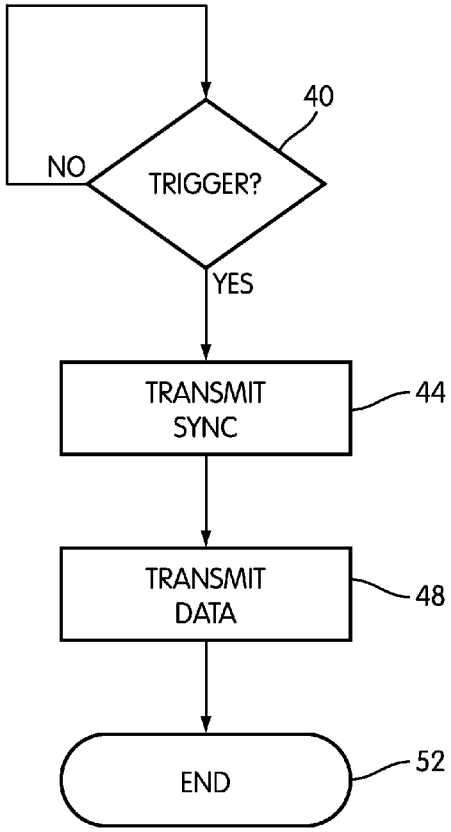
FIG. 8 is a flowchart of a method for transmitting golf swing data.

FIG. 8 is a flowchart of a method for transmitting golf swing data. In an initial embodiment of the method, ball data module 11 transmits ball-related golf swing data 12. In further embodiments of the method, club data module 21 transmits club-related golf swing data 24. In the initial embodiment of the method, in step 40, ball data module 11 evaluates whether a trigger condition has occurred. If a trigger condition has not occurred, step 40 is repeated.

A trigger condition may occur if ball data module 11 passively senses the proximity of mobile computing auxiliary device capable of receiving transmitted golf swing data, such as mobile computing auxiliary device 30. For example, in some embodiments, an RFID tag in mobile computing auxiliary device 30 may wirelessly signal its presence when brought in proximity to golf ball 10.

Alternatively, a trigger condition may occur if ball data module 11 actively senses the wirelessly-signaled presence of mobile auxiliary device 30. For example, in some embodiments, a Bluetooth communication device in mobile computing auxiliary device 30 may intermittently or periodically signal its presence to golf ball 10.

Under a further alternative, a trigger condition may effectively occur continuously. For example, in some embodiments, a trigger condition may occur in reaction to a periodic or intermittent timer in ball data module 11. (In such embodiments, the transmission of ball-related golf swing data 12 may periodically or intermittently be attempted, even though no external triggering condition occurs.)

If a trigger condition occurs, ball data module 11 proceeds to step 44. In step 44, ball data module 11 may execute the transmit-side of a synchronization protocol. A synchronization protocol may prepare a data module and a mobile computing auxiliary device to coordinate, respectively, a transmit-side and of a data-transmission protocol and a receive-side of a data-transmission protocol. For example, in some embodiments, ball data module 11 may transmit a sequence of digital values comprising a sync identifier. In other embodiments, ball data module 11 may transmit an analog sync identifier.

Under a further alternative, the transmit-side of a synchronization protocol may be passively satisfied. For example, the transmit-side of a synchronization protocol may merely consist of waiting for a protocol-specified synchronization time instead of actively transmitting a digital or analog sync identifier.

After executing the transmit-side of a synchronization protocol, ball data module 11 proceeds to step 48. In step 48, ball data module 11 executes the transmit-side of a data-transmission protocol. For example, in some embodiments, transmission element 19 of ball data module 11 may transmit a sequence of digital values comprising a portion of ball-related golf swing data 12, in accordance with a data-transmission protocol. In such embodiments, specific types of ball-related golf-swing data (i.e., data regarding the location of the ball) may be identified by time-wise position in a sequence of the protocol, by an accompanying set of tag bits, or by virtue of being transmitted on a specific communications channel (such as a specific frequency or predetermined set of frequencies.) In other embodiments, transmission element 19 may transmit an analog signal comprising a portion of ball-related golf swing data 12, in accordance with a data-transmission protocol.

After executing the transmit-side of a data-transmission protocol, ball data module 11 proceeds to step 52, and transmission of ball-related golf-swing data 12 by ball data module 11 ends. Ball data module 11 may optionally return to step 40 in preparation for subsequent transmission of ball-related golf swing data 12.

In some embodiments, ball-related golf swing data 12 may be transmitted substantially immediately after being captured, or through a protocol that introduces minimal, if any, delay between capturing the golf swing data and transmitting the golf swing data. That is, with reference to FIG. 2B, in some embodiments of golf ball 10, transmission element 19 may transmit data captured by capture element 17 substantially immediately after being captured, whereas in other embodiments, transmission element 19 may transmit data placed and stored in storage element 18 by capture element 17.

Similarly, in some embodiments of golf club 20, transmission element 29 may transmit data captured by capture element 27 substantially immediately after being captured, whereas in other embodiments, transmission element 29 may transmit data placed and stored in storage element 28 by capture element 27.

Figure 9:
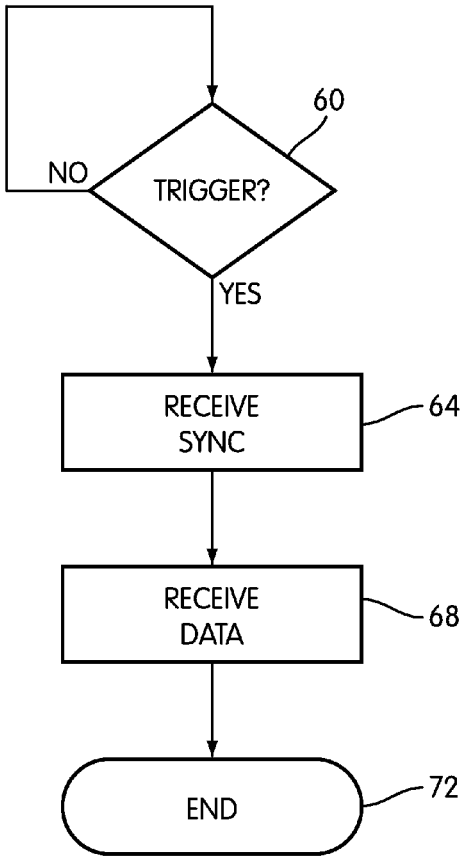
FIG. 9 is a flowchart of a method for receiving golf swing data.

FIG. 9 is a flowchart of a method for receiving golf swing data. In an initial embodiment of the method, mobile computing auxiliary device 30 receives ball-related golf swing data 12. In other embodiments of the method, mobile computing auxiliary device 30 receives club-related golf swing data 24. In the initial embodiment of the method, in step 60, mobile computing auxiliary device 30 evaluates whether a trigger condition has occurred. If a trigger condition has not occurred, step 60 is repeated.

A trigger condition may occur if mobile computing auxiliary device 30 passively senses the proximity of a golf ball capable of transmitting golf swing data, such as golf ball 10. For example, in some embodiments, an RFID tag in ball data module 11 may wirelessly signal its presence when golf ball 10 is brought in proximity to mobile computing auxiliary device 30.

Alternatively, a trigger condition may occur if mobile computing auxiliary device actively senses the wirelessly-signaled presence of golf ball 10. For example, in some embodiments, a Bluetooth communication device in ball data module 11 may intermittently or periodically signal its presence to mobile computing auxiliary device 30.

Under a further alternative, a trigger condition may effectively occur continuously. For example, in some embodiments, a trigger condition may occur in reaction to a periodic or intermittent timer in mobile computing auxiliary device 30. (In such embodiments, receiving ball-related golf swing data 12 may be periodically or intermittently attempted, even though no external triggering condition occurs.)

If a trigger condition occurs, mobile computing auxiliary device 30 proceeds to step 64. In step 64, mobile computing auxiliary device may execute the receive-side of a synchronization protocol. For example, in some embodiments, mobile computing auxiliary device 30 may examine a received sequence of digital values to determine whether they comprise a sync identifier. In other embodiments, mobile computing auxiliary device 30 may examine a received analog signal to determine whether it comprises a sync identifier. Completion of the receive-side of a synchronization protocol may include a positive determination that a sync identifier has been received.

After executing the receive-side of a synchronization protocol, mobile computing auxiliary device 30 proceeds to step 68. In step 68, mobile computing auxiliary device 30 executes the receive-side of a data-transmission protocol. For example, in some embodiments, mobile computing auxiliary device 30 may receive a sequence of digital values comprising a portion of ball-related golf swing data 12, in accordance with a data-transmission protocol. In such embodiments, specific types of ball-related golf-swing data may be identified by a time-wise position in a sequence of the protocol, by an accompanying set of tag bits, or by virtue of being received on a specific channel (such as a specific frequency or a predetermined set of frequencies.) In other embodiments, mobile computing auxiliary device 30 may receive an analog signal comprising a portion of ball-related golf swing data 12, in accordance with a data-transmission protocol. A portion of ball-related golf swing data 12 may then be captured as ball-related golf swing data 32.

After executing the receive-side of a data-transmission protocol, mobile computing auxiliary device proceeds to step 72, and the receipt of ball-related golf-swing data 12 by mobile computing auxiliary device 30 ends. Mobile computing auxiliary device 30 may optionally return to step 60 in preparation for subsequent reception of ball-related golf swing data 12.

Figure 10:
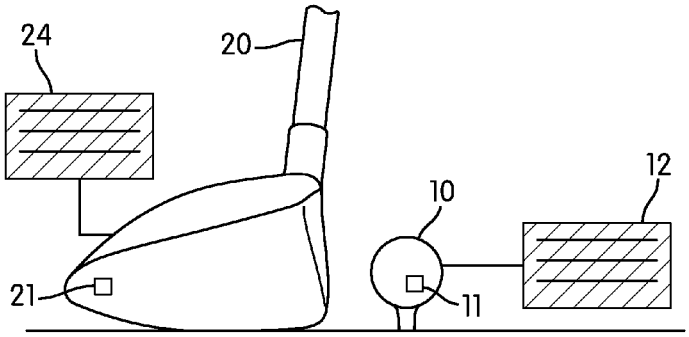
FIG. 10 is a schematic plan view of an embodiment of a golf club and a golf ball.
Figure 11:
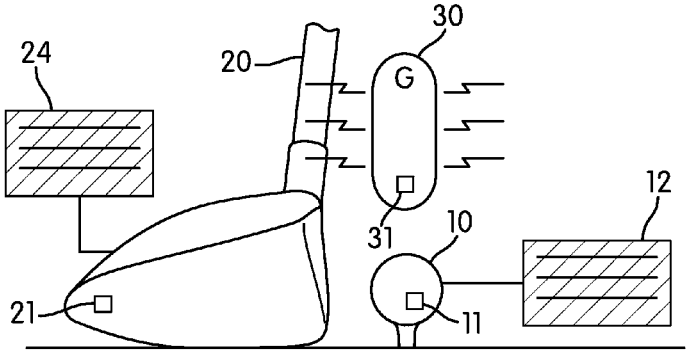
FIG. 11 is a schematic plan view of an embodiment of a golf club, a golf ball, and a mobile computing auxiliary device placed in proximity with each other.
Figure 12:
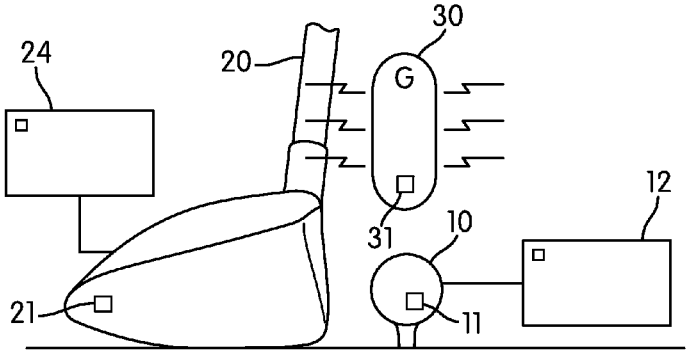
FIG. 12 is a schematic plan view of an embodiment of a golf club, a golf ball, and a mobile computing auxiliary device in proximity with each other.

FIGS. 10-12 depict embodiments of golf ball 10 and golf club 20 being initialized by mobile computing auxiliary device 30. FIG. 10 is a schematic plan view of an embodiment of golf club 20 and golf ball 10. Referring to FIG. 10, golf ball 10 and golf club 20 are at rest, before golf club 20 has been swung to strike golf ball 10. Ball-related golf swing data 12 and club-related golf swing data 10 have irrelevant values (such as previously-captured values, initial values, spurious values remaining from decayed values, or other "garbage" or "don't-care" values).

FIG. 11 is a schematic plan view of an embodiment of golf club 20, golf ball 10, and mobile computing auxiliary device 30 placed in proximity with each other. Referring to FIG. 11, mobile computing auxiliary device 30 has been placed in proximity to golf ball 10 and golf club 20. Subsequently, mobile computing auxiliary device 30 may transmit an initialization signal, which may be a digital signal or an analog signal.

FIG. 12 is a schematic plan view of an embodiment of golf club 20, golf ball 10, and mobile computing auxiliary device 30 in proximity with each other. Referring to FIG. 12, golf ball 10 and golf club 20 have received the initialization signal. Receipt of the initialization signal by golf ball 10 may cause ball-related golf swing data 12 to take on a set of known initial or reset values. Receipt of the initialization signal by golf club 20 may cause club-related golf swing data 24 to take on a known set of initial or reset values. A confirmation indicator in golf ball 10 (not shown) may provide audible, visible, or tactile confirmation of the initialization of ball-related golf swing data 12. Similarly, a confirmation indicator in golf club 20 (not shown) may provide audible, visible, or tactile confirmation or the initialization of club-related golf swing data 24.

Accordingly, in the course of activities related to a golf swing, ball-related golf swing data 12 in golf ball 10 may be initialized by a mobile computing auxiliary device 30. Ball data module 11 of golf ball 10 may then capture golf swing data as ball-related golf swing data 12. Thereafter, ball data module 11 may transmit ball-related golf swing data to mobile computing auxiliary device 30. Alternatively, club-related golf swing data 24 in golf club 20 may be initialized by a mobile computing auxiliary device. Club data module 21 may then capture golf swing data as club-related golf swing data 24. Thereafter, club data module 21 may transmit club-related golf swing data to mobile computing auxiliary device 30.

Figure 13:
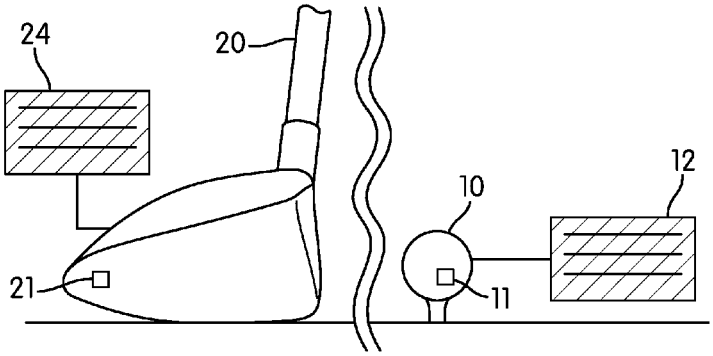
FIG. 13 is a schematic plan view of an alternate embodiment of a golf club and a golf ball.
Figure 14:
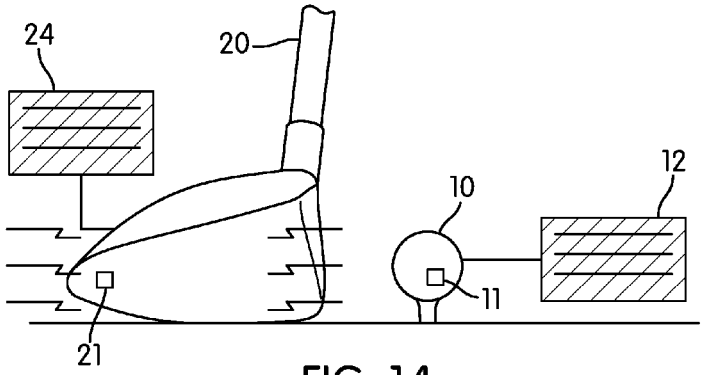
FIG. 14 is a schematic plan view of an alternate embodiment of a golf club and a golf ball placed in proximity with each other.
Figure 15:
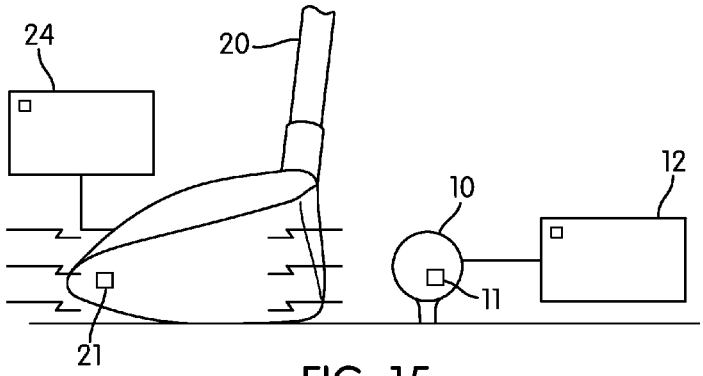
FIG. 15 is a schematic plan view of an alternate embodiment of a golf club and a golf ball in proximity with each other.

FIGS. 13-15 depict alternate embodiments of golf ball 10 and golf club 20 being initialized. FIG. 13 is a schematic plan view of an alternate embodiment of golf club 20 and golf ball 10. Referring to FIG. 13, golf ball 10 and golf club 20 are at rest, before golf club 20 has been swung to strike golf ball 10, separated by some distance such that they are not in proximity to each other. Ball-related golf swing data 12 and club-related golf swing data 10 have irrelevant values.

FIG. 14 is a schematic plan view of an alternate embodiment of golf club 20 and golf ball 10 placed in proximity with each other. Referring to FIG. 14, golf club 20 has been placed in proximity to golf ball 10. Subsequently, golf club 20 may transmit an initialization signal, which may be a digital signal or an analog signal.

FIG. 15 is a schematic plan view of an alternate embodiment of golf club 20 and golf ball 10 in proximity with each other. Referring to FIG. 15, ball data module 11 has received the initialization signal, and golf club 20 has processed its own transmitted initialization signal. Receipt of the initialization signal by ball data module 11 may cause ball-related golf swing data 12 to take on a set of known initial or reset values. Processing by club data module 21 of the initialization signal transmitted by golf club 20 may cause club-related golf swing data 24 to take on a known set of initial or reset values. Confirmation indicators in golf ball 10, golf club 20, or both (not shown) may provide audible, visible, or tactile confirmation of the initialization of ball related golf swing data 12 or club related golf swing data 24.

Accordingly, in the course of activities related to a golf swing, either or both of ball-related golf swing data 12 in golf ball 10 and club-related golf swing data 24 in golf club 20 may be initialized by golf club 20.

Figure 16:
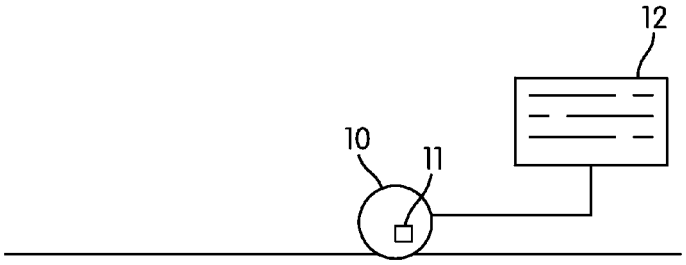
FIG. 16 is a schematic plan view of an alternate embodiment of a golf ball.
Figure 17:
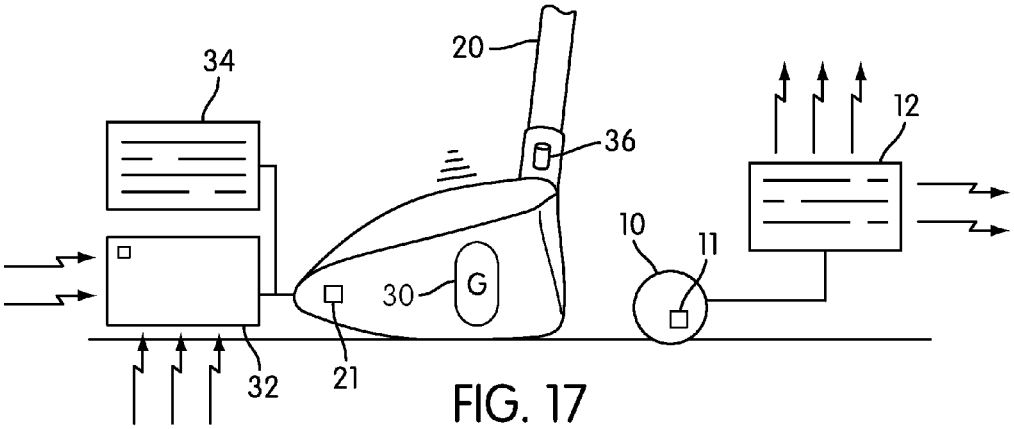
FIG. 17 is a schematic plan view of an alternate embodiment of a golf ball and a golf club placed in proximity with each other.
Figure 18:
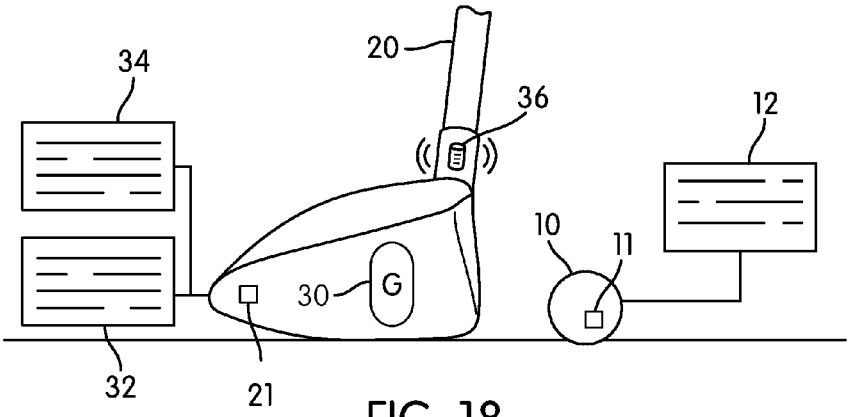
FIG. 18 is a schematic plan view of an alternate embodiment of a golf ball and a golf club in proximity with each other.

FIGS. 16-18 depict alternate embodiments of golf ball 10 transmitting ball-related golf swing data 12 to golf club 20. FIG. 16 is a schematic plan view of an alternate embodiment of golf ball 10. Referring to FIG. 16, golf ball 10 has come to rest after having been struck by a golf club. Ball data module 11 has captured ball-related golf swing data 12.

FIG. 17 is a schematic plan view of an alternate embodiment of golf ball 10 and golf club 20 placed in proximity with each other. Referring to FIG. 17, club data module 21, which has captured club-related golf swing data 34, has been placed in proximity to golf ball 10. Golf club 20 has an integrated mobile computing auxiliary device 30. Subsequently, ball data module 11 may transmit ball-related golf swing data 12, by any type of wireless communication mechanism. The transmission of ball-related golf swing data 12 may be triggered, for example, by bringing golf club 20 in proximity to golf ball 10, or it may be triggered by a periodic timer.

FIG. 18 is a schematic plan view of an alternate embodiment of golf ball 10 and golf club 20 in proximity with each other. Referring to FIG. 18, club data module 21 has received ball-related golf swing data 12 and captured it as ball-related golf swing data 32. Ball-related golf swing data 12 may be received by a wireless communication mechanism complementary to the wireless communication mechanism used to transmit ball-related golf swing data 12.

Upon capturing ball-related golf swing data 12 as ball-related golf swing data 32, club data module 21 may activate confirmation indicator 36 to confirm receipt of ball-related golf swing data 12.

Accordingly, in the course of activities related to a golf swing, an initialized ball data module 11 may capture golf swing data as ball-related golf swing data 12. Thereafter, ball data module 11 may transmit ball-related golf swing data 12 to club data module 21.

Figure 19:
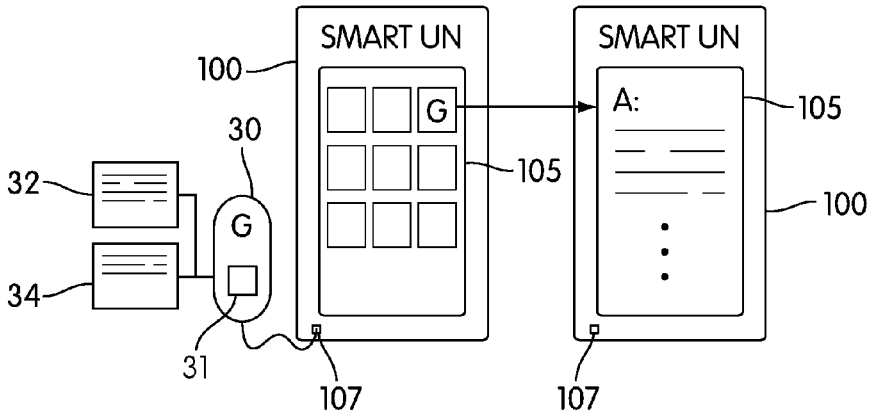
FIG. 19 depicts an embodiment of a mobile computing auxiliary device and a mobile computing device.

FIG. 19 depicts an embodiment of mobile computing auxiliary device 30 and mobile computing device 100. Mobile computing auxiliary device 30 may communicate captured data, such as ball-related golf swing data 32 or club-related golf swing data 34, to mobile computing device receiver 107 of mobile computing device 100. In some embodiments, transmission element 39 may transmit data captured by capture element 37. In other embodiments, transmission element 39 may transmit data stored in storage element 38 (which may include any type of memory, volatile or non-volatile) after having previously been captured by capture element 37.

Transmission element 39 in auxiliary data module 31 of mobile computing auxiliary device 30 may transmit golf swing data to mobile computing device receiver 107 over a serial or parallel physical communication channel (such as a cable, wire, or bus) or by a single-channel or multiple-channel wireless communication mechanism. Mobile computing device receiver 107 may receive data transmitted from transmission element 39. Data received by mobile computing device receiver 107 may then be relayed to mobile computing device 100.

Figure 20:
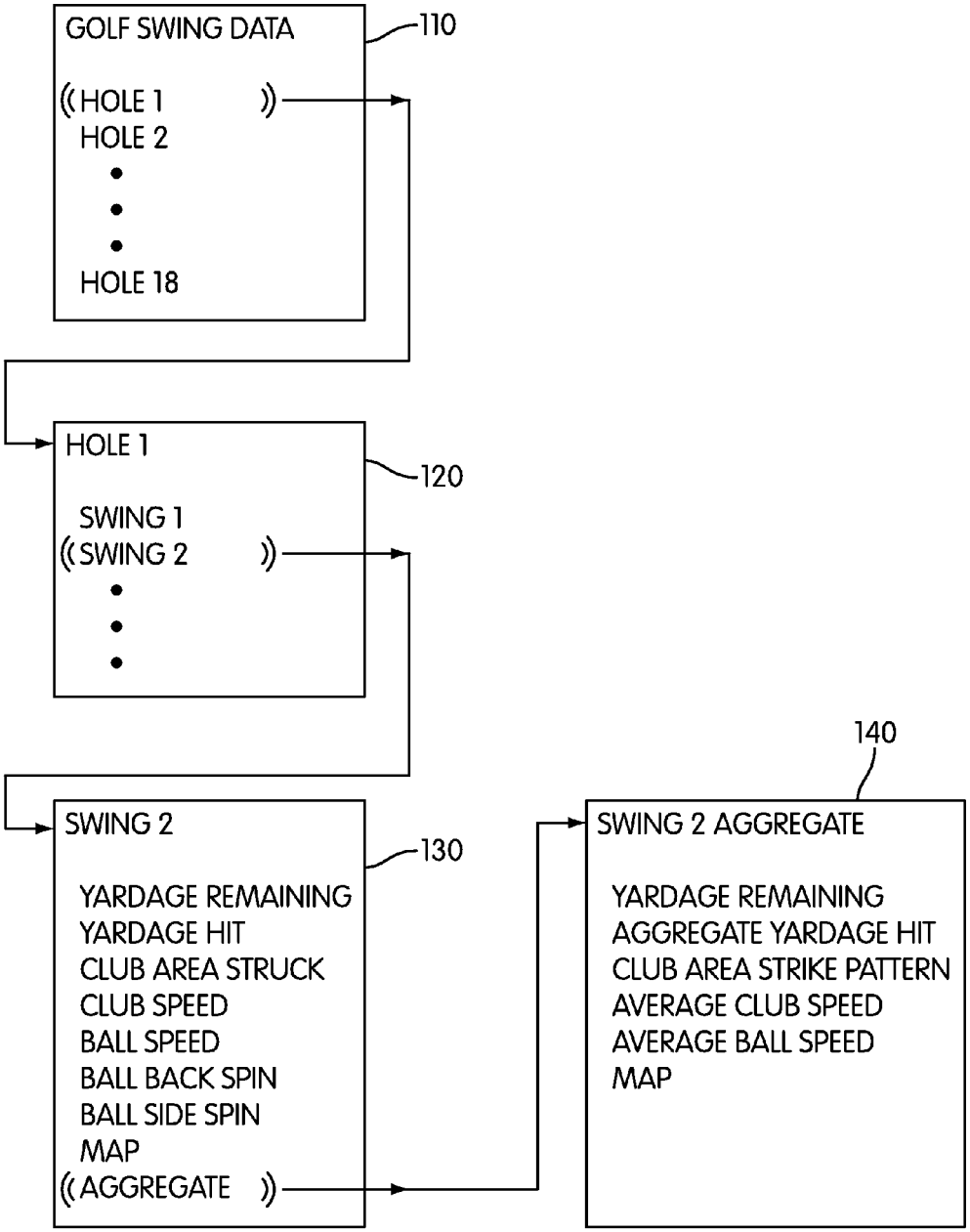
FIG. 20 depicts an embodiment of a screen shots within a menu tree of a mobile computing auxiliary device.

FIG. 20 depicts an embodiment of a screen shots within a menu tree of mobile computing device 100. Mobile computing device 100 may have a view screen 105, which may be any view screen suitable in the art. View screen 105 may comprise one or more seven segment displays or dot matrix displays. View screen 105 may be a monochromatic or color display, and may be a liquid crystal-based display or an electronic ink-based display. View screen 105 may be a touch-screen display, such as a multi-touch display. In embodiments in which view screen 105 is a touch-screen display, a user may touch view screen 105 in order to interact with mobile computing device 100. In other embodiments, a user may interact with mobile computing device 100 through any other suitable alternate input device. For example, a user may interact with mobile computing device 100 through one or more buttons, a keyboard, a chorded keyboard, a mouse, a trackball, a touchpad, a pointing stick, or voice.

After receiving ball-related golf swing data 32 or club-related golf swing data 34 from mobile computing device receiver 107, mobile computing device 100 may display ball-related golf swing data 32 or club-related golf swing data 34 in a suitable form on view screen 105. View screen 105 may display various levels in a menu tree through which captured golf swing data (such as ball-related golf swing data 32 or club-related golf swing 34) may be accessed.

A user may interact with mobile computing device 100 to navigate among the various levels in the menu tree. Referring to FIG. 20, in display 110, the menu presents captured golf swing data as data associated with each of holes 1 through 18. A user selects "Hole 1" and is presented with display120. In display 120, the menu presents captured golf swing data associated with hole 1 as data associated with a plurality of swings. A user selects "Swing 2" and is presented with display 130. In display 130, the menu presents captured golf swing data as data falling into various categories, such as yardage remaining at the end of the swing, yardage hit, the area of the club face struck, the speed of the club, the speed of the ball, the back spin of the ball, the side spin of the ball, a map-based representation of location data, or aggregate categories. A user selects "Aggregate" and is presented with display 140. In display 140, the menu presents captured golf swing data as data falling into various aggregate categories, such as yardage remaining at the end of the swing, aggregate yardage hit, the pattern of strikes on the club face, the average club speed, the average ball speed, and a map-based representation of aggregate location data.

In some embodiments, the view screen 110 may present displays that are the product of a dedicated application running on the hardware of mobile computing device 30. For example, the view screen 110 may present displays that are the product of a dedicated application running on a smart phone.

Figure 21:
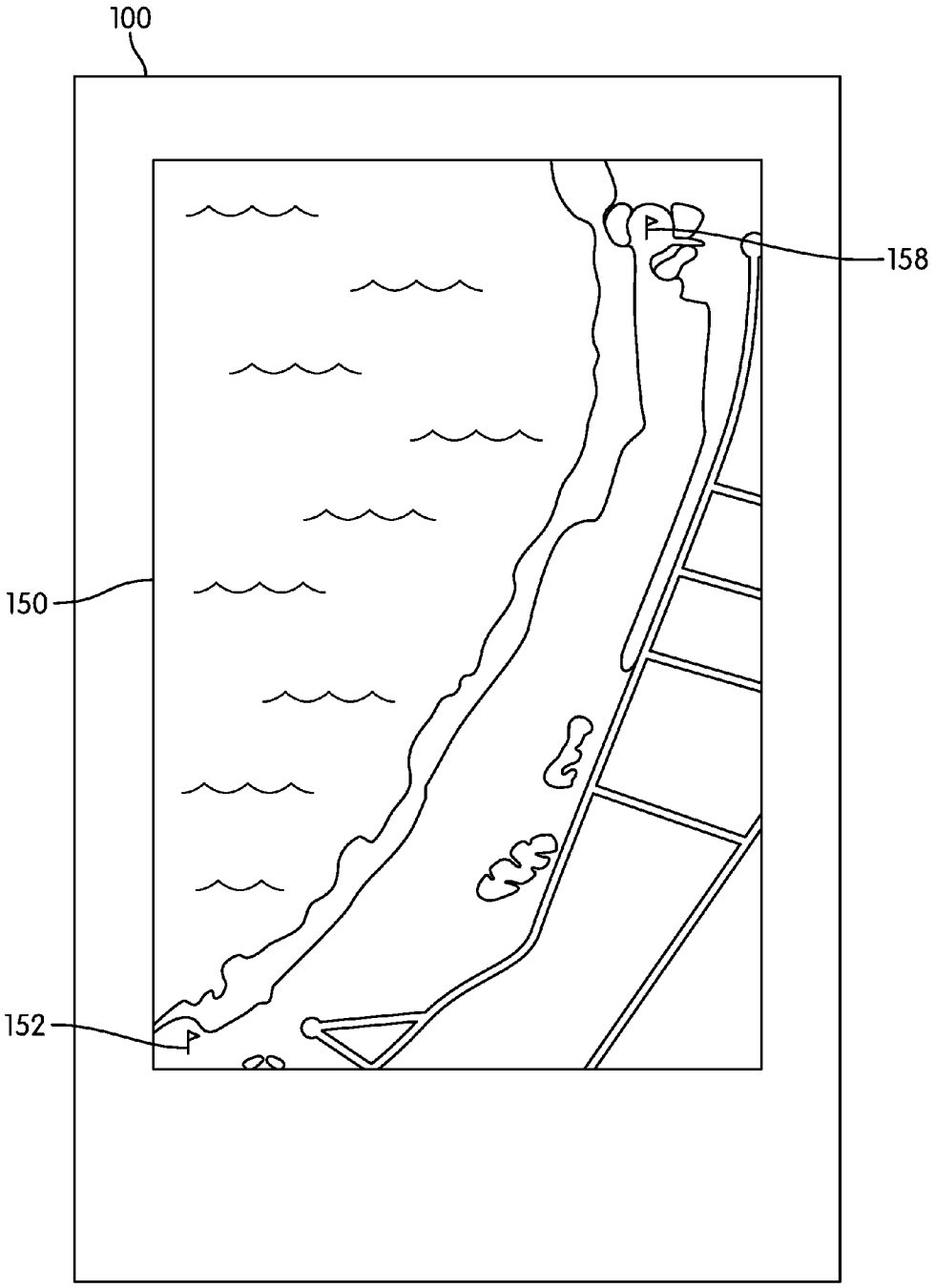
FIG. 21 depicts an embodiment of a screen shot of a mobile computing device.

FIG. 21 depicts an embodiment of a screen shot of mobile computing device 100. In this embodiment, a user beginning play on a golf hole has navigated through a displayed menu tree on mobile computing device 100. The user has selected golf swing data associated with a particular golf hole, has selected "Swing 1," has selected to view a map of location data, and has been presented with display 150, depicting an overhead map of the hole before any swings have been made. Display 150 may include tee indicator 152, hole indicator 158, or both. Display 150 may provide a report (not shown) of the distance and direction remaining between the tee and the hole, as well as other information useful to play, such as wind direction and speed.

Figure 22:
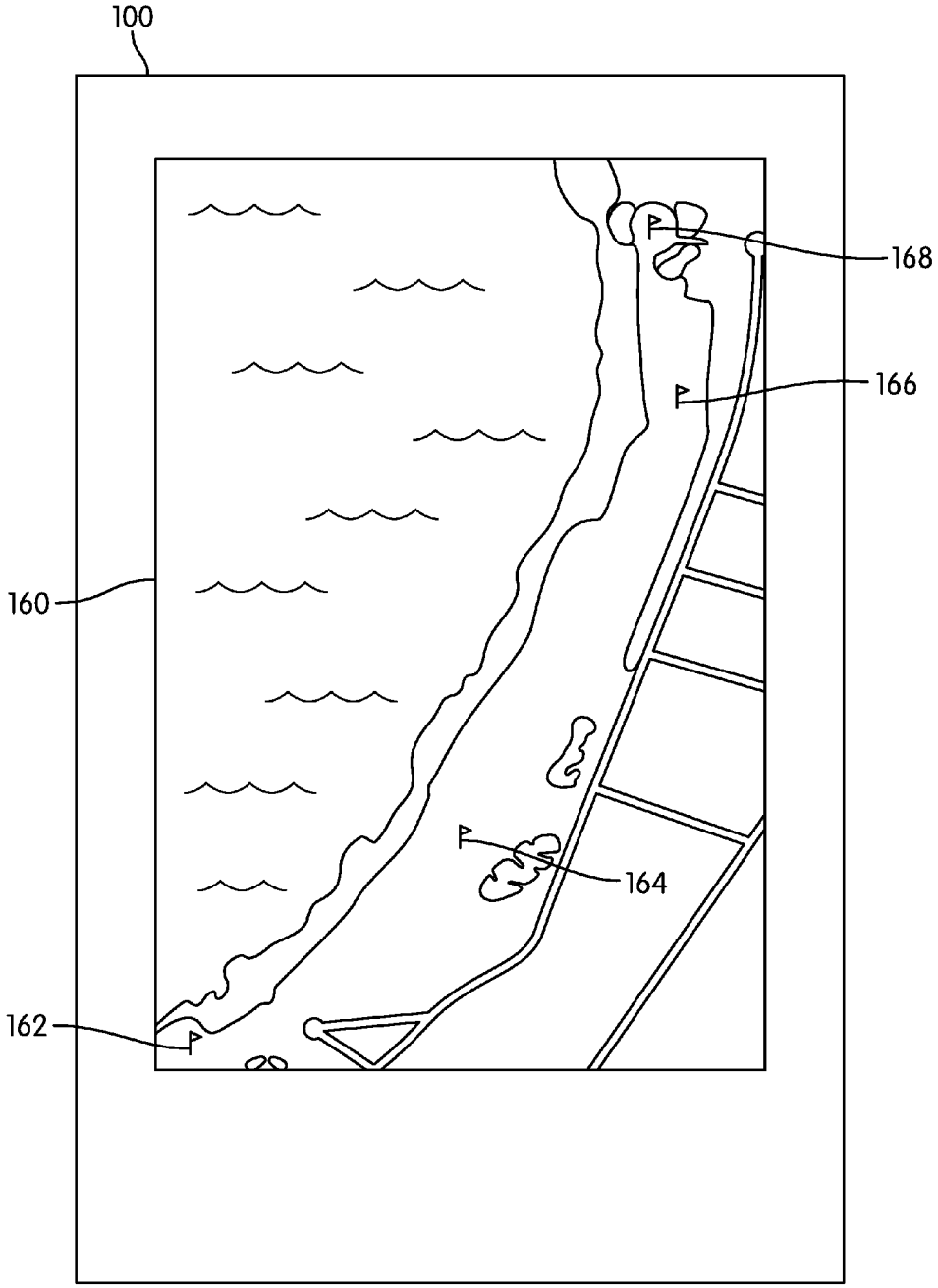
FIG. 22 depicts a further embodiment of a screen shot of a mobile computing device.

FIG. 22 depicts a further embodiment of a screen shot of mobile computing device 100. In this embodiment, a user has struck a ball twice in the course of playing a golf hole, has captured golf swing data in the course of the associated golf swings, has relayed the captured golf swing data to mobile computing device 100, and has navigated through a displayed menu tree on mobile computing device 100. In the course of navigating the menu tree, the user has selected golf swing data associated with the particular golf hole, has selected "Swing 2," has selected to view a map of location data, and has been presented with display 160, depicting an overhead map of the hole after both swings. Display 160 may include any of tee indicator 162, first swing location indicator 164, second swing location indicator 166, or hole indicator 168. Display 160 may provide a report (not shown) of the distance and direction remaining between the ball's location after the second swing and the hole. Display 160 may also provide a report of the distance and direction between the tee and the ball's location after the first swing, between the ball's location after the first swing and the ball's location after the second swing, or between the tee and the ball's location after the second swing.

Figure 23:
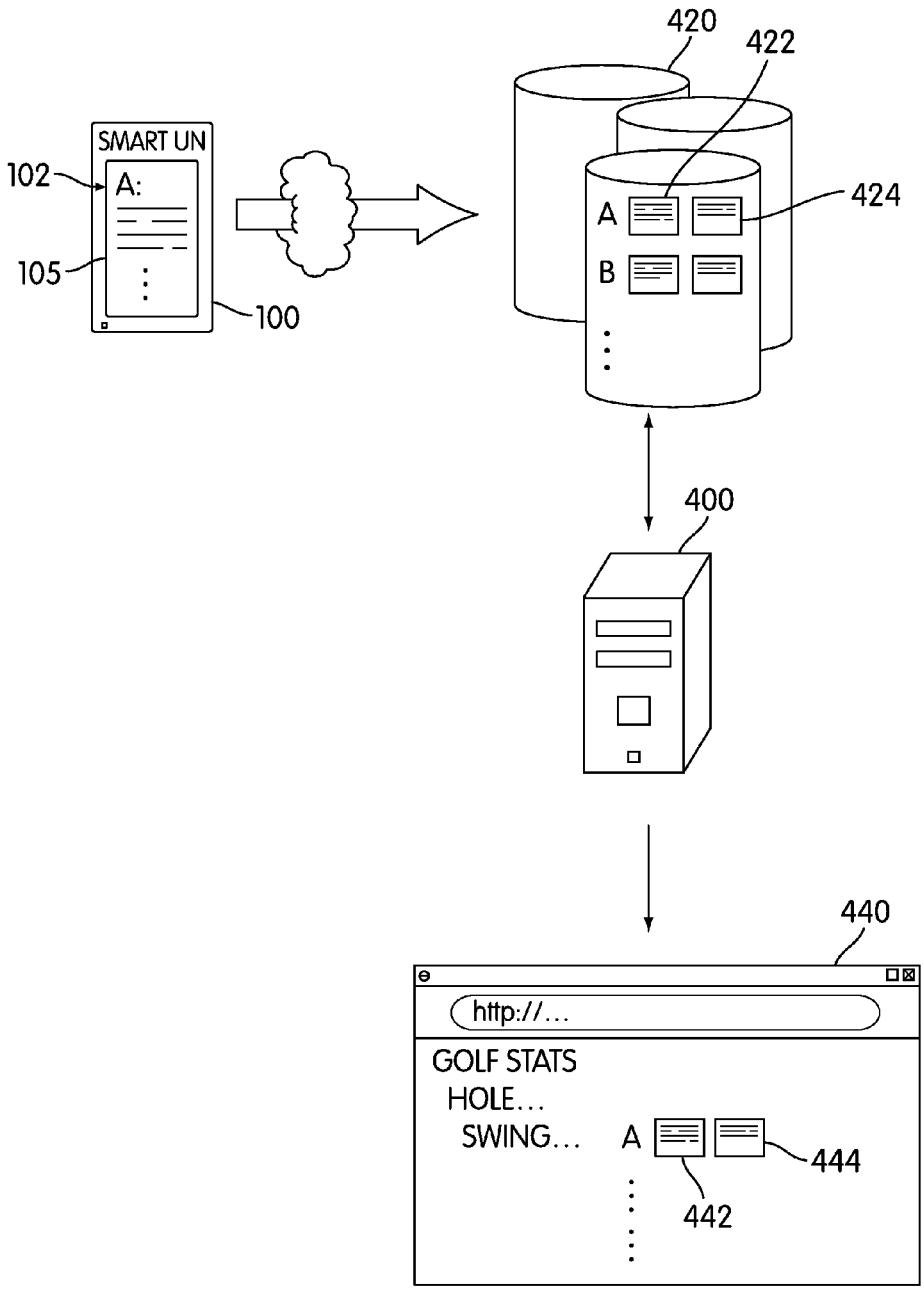
FIG. 23 depicts an embodiment of a mobile computing device, a database, a server, and a web page.

FIG. 23 depicts an embodiment of mobile computing device 100, database 420, server 400, and web page 440. Referring to FIG. 23, mobile computing device 100 transmits ball related golf swing data 102 and club related golf swing data (not shown) to database 420 through a wireless communication mechanism, such as a wireless internet connection. In some embodiments, mobile computing device 100 has no view screen 105, or does not make use of a view screen it has, but does communicate golf swing data to a database.

In some embodiments, database 420 may receive golf swing data from mobile computing device 100 through a direct connection, such as a wired internet connection. In other embodiments, golf swing data may be transmitted from mobile computing device 100 to database 420 through a network of distinct communication channels, some of which may incorporate wireless communication mechanisms, others of which may incorporate wired communication mechanisms.

Database 420 captures ball related golf swing data 102 as ball related golf swing data 422, and the club related golf swing data from mobile computing device 100 (not shown) as club related golf swing data 424. Database 420 may be associated with a mainframe computer, a workstation, a server, or a set of servers, such as a "server farm." For example, database 420 may include volatile or non-volatile memory or storage within server 400. Database 420 may be centrally located, or may be distributed across a plurality of physically separate locations. In embodiments where database 420 is distributed across a plurality of physically separate locations, the locations may be separated by any distance, whether a negligible distance, a great distance, or any distance in between. In other words, database 160 may include memory or storage located in any number of servers separated by any physical distance.

A server interoperating with database 420 may subsequently supply ball related golf swing data 422 and club related golf swing data 424 to a web page. For example, database 420 may supply ball related golf swing data 422 to web page 440 as ball related golf swing data 442. Alternatively, database 420 may supply club related golf swing data 424 to web page 440 as club related golf swing data 444.

In turn, server 400 may make web page 440 accessible over the internet to a web browser. Server 400 interoperating with database 420 may be integrally connected to or housed with database 420. Alternatively, server 400 may be separated from database 420 by any distance.

Figure 24:
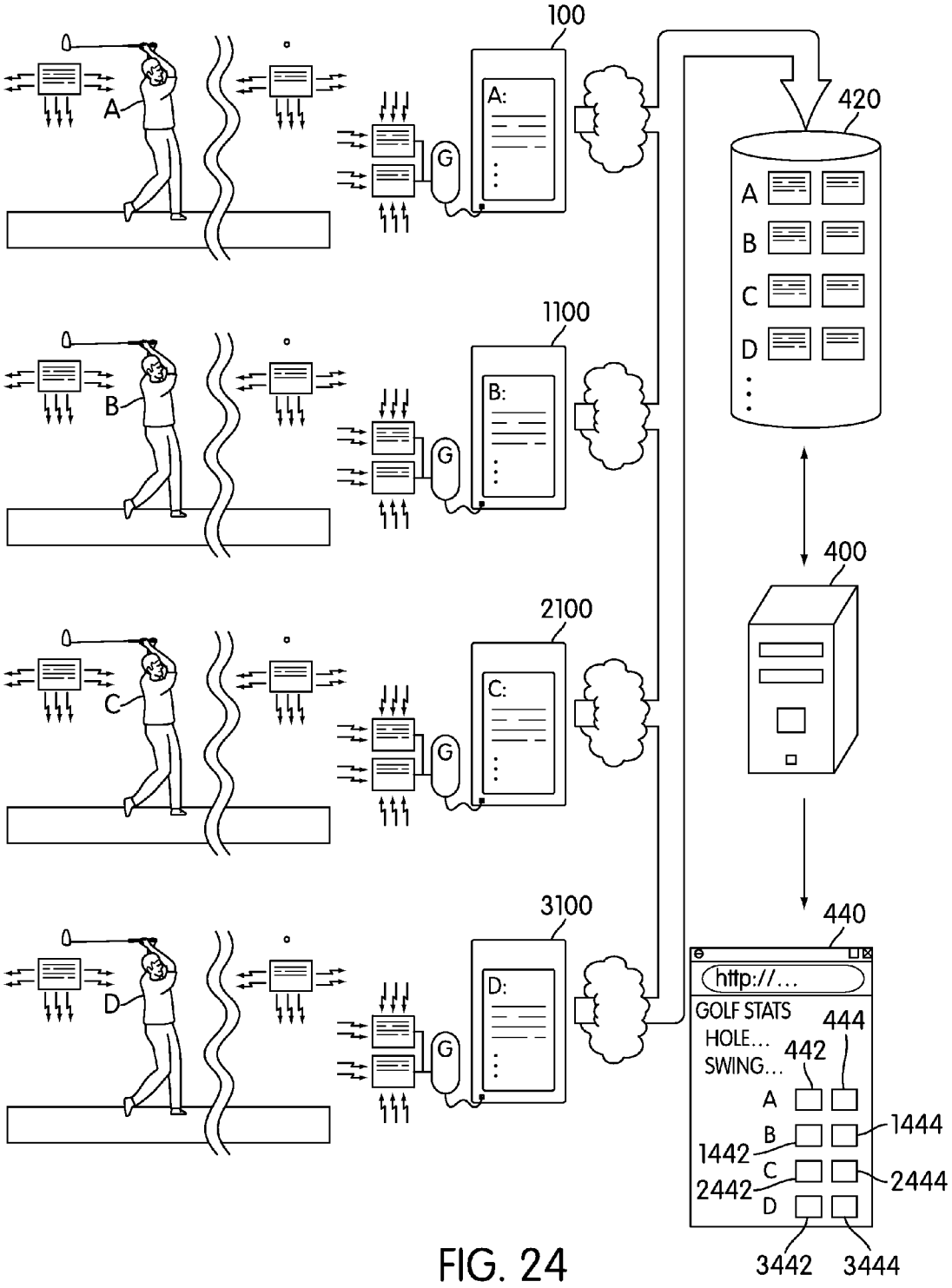
FIG. 24 depicts an embodiment of a database, a server, and a web page that allows multiple users at multiple locations to compare results.

FIG. 24 depicts an embodiment of database 420, server 400, and web page 440 that allows multiple users at multiple locations to compare results. Database 420 may be used to back up golf swing data. Additionally, database 420 may be used to allow several users to compare golf swing data. Online performance comparisons and competitions are known, such as the Nike+iPod® system, or the system described in U.S. Pat. No. 7,072,789, which is incorporated herein by reference. In the embodiment shown in FIG. 24, four users A, B, C, and D are executing golf swings. Data modules in the golf balls and golf clubs used by users A, B, C, and D capture data associated with golf swings during the course of the golf swings and transmit that data. Mobile computing auxiliary devices may then receive the transmitted golf swing data and transmit the golf swing data to mobile computing device 100, mobile computing device 1100, mobile computing device 2100, and mobile computing device 3100. The mobile computing devices may display the golf swing data, and may transmit the golf swing data to database 420.

Database 420 may be associated with server 400, which may make the golf swing data of users A, B, C, and D available over the internet via web page 440. For example, with respect to golf swing data from user A in mobile computing device 100, server 400 may make ball-related golf swing data available as ball-related golf swing data 442, and may make club-related golf swing data available as club-related golf swing data 444. With respect to golf swing data from user B in mobile computing device 1100, server 400 may make ball-related golf swing data available as ball-related golf swing data 1442, and may make club-related golf swing data available as club-related golf swing data 1444. With respect to golf swing data from user C in mobile computing device 2100, server 400 may make ball-related golf swing data available as ball-related golf swing data 2442, and may make club-related golf swing data available as club-related golf swing data 2444. With respect to golf swing data from user D in mobile computing device 3100, server 400 may make ball-related golf swing data available as ball-related golf swing data 3442, and may make club-related golf swing data available as club-related golf swing data 3444.

Server 400 may gather golf swing data for users A, B, C, and D and make the gathered golf swing data available via web page 440, where users may access and compare the data.

Additionally, the gathered golf swing data may be used by server 400 to compare the performance of users A, B, C, and D. The golf swing data may be used to compare the users' scores in a game. Additionally, the golf swing data may also be used to compare the users' performance against any of the range of parameters related to the gathered golf swing data.

For example, ball speed or yardage attained by users in the first swing of a particular hole may be compared. Alternatively, the location on the faces of the golf clubs of the point of contact between the golf clubs and the golf balls may be compared, for any particular swing of any particular hole, or for a range of swings over a range of holes. As a further alternative, the conformance between the profile of spatial positions and orientations of the golf clubs achieved by the users, for any particular swing of any particular hole, may be compared, either between and among the users, or with a reference or target profile of spatial positions and orientations of a golf club.

Server 400 may facilitate competitions or challenges to compare various aspects of performance in golfing among various numbers of users. For example, a plurality of users may participate in competition with each other, and server 400 may track data associated with that competition. In some embodiments, a plurality of users may play a game of golf together on the same golf course. Subsequently, golf swing data captured for each user may be transmitted to server 400. Server 400 may then compare the golf swing data captured for each user against parameters such as a pre-determined par associated with each hole of the golf course and determine a winner or place ranking for the competition. Information regarding the competition, including the determination of the winner or the place ranking, may be made available via a web page where the users and others may access and view it.

In some embodiments, the server may then associate a user with any of a number of awards based on the user's performance in the competition. The awards may include tangible awards, such as trophies or money. The awards may also include virtual awards, such as a graphical icons, virtual money, or points.

Alternatively, instead of participating in a direct competition in the each others' presence, a plurality of users may participate in virtual competitions with each other, and server 400 may track data associated with that virtual competition. In some embodiments, a plurality of users may actually play the same physical course, but at different times. Subsequently, golf swing data captured for each user may be transmitted to server 400, may be used to determine a winner or place ranking, and may be made available via a web page, as if all users had been actually playing the same physical course in each others' presence.

In other embodiments, a plurality of users may play a hole of golf virtually. In such embodiments, a user may engage in one or more golf swings at one location in order to virtually play a particular hole of a known golf course, and those golf swings may be compared against known parameters associated with the particular hole, such as distance, direction, and the general layout of the hole. The hole being played virtually may be a hole at an actual golf course, and the known distance and direction requirements may be associated with the particular hole of the actual golf course.

For example, a plurality of users may choose to virtually play a particular hole of the Pebble Beach golf course. Toward that end, the users may engage in actual golf swings on a driving range. Subsequently, server 400 may compare golf swing data captured for each user, such as a distance achieved by each actual golf swing of each user, against known parameters associated with the particular hole of the Pebble Beach golf course. Accordingly, an actual performance of each user on the driving range may be associated with, mapped onto, or otherwise translated into a virtual performance of each user on the particular hole of the Pebble Beach golf course. This virtual performance information may be made available via a web page, as if the users had actually been playing the particular hole of the Pebble Beach golf course. In this manner, one or more users may virtually play any number of known golf holes on any particular known golf course. Additionally, one or more users may virtually play a combination of known golf holes selected from any number of known golf courses.

In further embodiments, golf swing data captured for one or more users may be compared against golf swing data of associated with specific performances of one or more particular golfers on particular holes of actual golf courses. The user or users may thereby participate in a virtual competition against particular golfers on particular holes of actual golf courses. The user or users may even virtually play on a particular golf hole as part of the virtual competition. In this manner, one or more users may virtually compete not only against themselves, but also against particular performances of particular golfers, such as particular professional athletes in particular games. For example, a user may compare their performance, including performance through virtual play, to a particular major golf championship of a particular year.

In some embodiments, server 400 may administer a challenge, wherein a number of users compete for a specific award or awards. The competition may be actual and direct, in which the users play in each others' presence, or by virtual competition, including virtual play of particular holes or courses. For example, server 400 may administer a challenge to determine which of a number of users achieves the longest drive on a golf swing over a period of days or weeks. Server 400 may maintain a ranking of the performance of all users against the challenge. Server 400 may then associate various users with the specific award or awards as a result of their performance against the challenge.

Server 400 may administer a number of challenges. Server 400 may also maintain a determination of the difficulty involved in various challenges, which may be a parameter influencing any tangible awards or virtual awards given as a result of the challenge. For example, more difficult challenges, such as playing on more difficult courses, may be associated with enhanced awards or better awards.

Additionally, a third party may sponsor a challenge. For example, a third party might describe a challenge, and offer one or more specific awards, actual or virtual, based on performance in the challenge. Such awards might include relatively minor awards for participation, and more substantial awards, such as cash or discounts associated with the sponsor's business.

While various embodiments of the invention have been described, the description is intended to be exemplary rather than limiting, and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A system for capturing and communicating golf swing data including at least one of ball-related golf swing data and club-related golf swing data, the system comprising:

a ball data module incorporated in a golf ball, the ball data module having a ball data capture element for capturing the ball-related golf swing data from the golf ball and a ball data transmission element for transmitting the ball-related golf swing data;

a club data module incorporated in a golf club, the club data module having a club data capture element for capturing the club-related golf swing data from the golf club; and a mobile computing auxiliary device integrated within the golf club, the mobile computing auxiliary device having an auxiliary receiving element for receiving both the ball-related golf swing data from the ball data module and the club-related golf swing data from the club data module, wherein the ball data transmission element is operable to transmit the ball-related golf swing data through a wireless communication mechanism, and wherein the ball data transmission element includes a radio-frequency identification tag.

2. The system of claim 1, wherein at least one of the ball data capture element and the club data capture element includes an accelerometer.

3. The system of claim 1, wherein at least one of the ball data capture element and the club data capture element includes a global positioning system receiver.

4. The system of claim 1, wherein the ball data transmission element includes a Bluetooth communication device.

5. The system of claim 1, wherein the auxiliary receiving element includes a Bluetooth communication device.

6. The system of claim 1, wherein the system further comprises a mobile computing device operable to receive at least one of the ball-related golf swing data and the club-related golf swing data; and wherein the mobile computing auxiliary device is operable to transmit at least one of the ball-related golf swing data and the club-related golf swing data to the mobile computing device.

7. The system of claim 6, wherein the mobile computing device is a smart phone.

8. The system of claim 1, wherein the ball-related golf swing data includes at least one of a ball type, a ball location at the beginning of a swing, a ball location after coming to rest, a ball speed, a ball acceleration, and a ball spin during flight.

9. The system of claim 1, wherein the club-related golf swing data includes at least one of a club type, a nature or location of a grip on the golf club, a club speed, a profile of club speed during a swing, a club spatial position and orientation, a profile of club spatial position and orientation during a swing, a spatial orientation of a face of the golf club at the moment of contact with the golf ball, and a location on the face of the golf club of a point of contact between the golf club and the golf ball.

10. The system of claim 1, wherein the ball data module includes a ball swing data storage element, and the ball data transmission element transmits the ball-related golf swing data stored in the ball data storage element.

11. A system for capturing and communicating golf swing data including at least one of ball-related golf swing data and club-related golf swing data, the system comprising:

a ball data module incorporated in a golf ball, the ball data module having a ball data capture element for capturing the ball-related golf swing data from the golf ball and a ball data transmission element for transmitting the ball-related golf swing data;

a club data module incorporated in a golf club, the club data module having a club data capture element for capturing the club-related golf swing data from the golf club; and a mobile computing auxiliary device integrated within the golf club, the mobile computing auxiliary device having an auxiliary receiving element for receiving both the ball-related golf swing data from the ball data module and the club-related golf swing data from the club data module, wherein the ball data transmission element is operable to transmit the ball-related golf swing data through a wireless communication mechanism, and wherein the ball data transmission element includes a Bluetooth communication device.

12. The system of claim 11, wherein at least one of the ball data capture element and the club data capture element includes an accelerometer.

13. The system of claim 11, wherein at least one of the ball data capture element and the club data capture element includes a global positioning system receiver.

14. The system of claim 11, wherein the ball data transmission element includes a radio-frequency identification tag.

15. The system of claim 11, wherein the auxiliary receiving element includes a Bluetooth communication device.

16. The system of claim 11, wherein the system further comprises a mobile computing device operable to receive at least one of the ball-related golf swing data and the club-related golf swing data; and wherein the mobile computing auxiliary device is operable to transmit at least one of the ball-related golf swing data and the club-related golf swing data to the mobile computing device.

17. The system of claim 16, wherein the mobile computing device is a smart phone.

18. The system of claim 11, wherein the ball-related golf swing data includes at least one of a ball type, a ball location at the beginning of a swing, a ball location after coming to rest, a ball speed, a ball acceleration, and a ball spin during flight.

19. The system of claim 11, wherein the club-related golf swing data includes at least one of a club type, a nature or location of a grip on the golf club, a club speed, a profile of club speed during a swing, a club spatial position and orientation, a profile of club spatial position and orientation during a swing, a spatial orientation of a face of the golf club at the moment of contact with the golf ball, and a location on the face of the golf club of a point of contact between the golf club and the golf ball.

20. The system of claim 11, wherein the ball data module includes a ball swing data storage element, and the ball data transmission element transmits the ball-related golf swing data stored in the ball data storage element.

* * * * *